US007059138B2

(12) United States Patent
Bonaquist et al.

(10) Patent No.: US 7,059,138 B2
(45) Date of Patent: Jun. 13, 2006

(54) BIOLOGICAL REFRIGERATION SYSTEM

(75) Inventors: Dante Patrick Bonaquist, Grand Island, NY (US); John Henri Royal, Grand Island, NY (US); Bryce Rampersad, Williamsville, NY (US); Richard J. Jibb, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 200 days.

(21) Appl. No.: 10/667,384

(22) Filed: Sep. 23, 2003

(65) Prior Publication Data

US 2005/0061006 A1 Mar. 24, 2005

(51) Int. Cl.
*F17C 9/02* (2006.01)

(52) U.S. Cl. ..... 62/51.1; 62/6; 62/45.1; 62/48.1; 62/48.2

(58) Field of Classification Search ..... 62/6, 62/51.1, 78, 89, 97, 404, 407, 440; 95/47
See application file for complete search history.

(56) References Cited

U.S. PATENT DOCUMENTS 3,427,817 A * 2/1969 Rietdijk ..... 62/113
3,447,339 A * 6/1969 Rietdijk ..... 62/500
3,464,230 A * 9/1969 Rietdijk ..... 62/500
4,300,356 A 11/1981 Notaro et al. ..... 62/50
5,003,787 A * 4/1991 Zlobinsky ..... 62/99
5,308,382 A * 5/1994 Prasad ..... 95/12
5,327,729 A * 7/1994 Yanai et al. ..... 62/606
5,979,440 A * 11/1999 Honkonen et al. ..... 128/201.21
6,076,372 A 6/2000 Acharya et al. ..... 62/606
6,128,914 A 10/2000 Tamaoki et al. ..... 62/440
6,205,794 B1 3/2001 Brothers ..... 62/51.1
6,327,865 B1 12/2001 Bonaquist et al. ..... 62/79
6,397,620 B1 6/2002 Kelly et al. ..... 62/275
6,426,019 B1 7/2002 Acharya et al. ..... 252/67
6,430,938 B1 8/2002 Royal et al. ..... 62/6
6,438,969 B1 * 8/2002 Laskaris et al. ..... 62/51.1
6,442,949 B1 * 9/2002 Laskaris et al. ..... 62/51.1
6,477,847 B1 * 11/2002 Bonaquist et al. ..... 62/99

* cited by examiner

*Primary Examiner*—Cheryl Tyler
*Assistant Examiner*—Richard L. Leung
(74) *Attorney, Agent, or Firm*—Stanley Ktorides

(57) ABSTRACT

A refrigeration system especially useful for refrigerating biological samples wherein a cryocooler, such as one employing a pressure wave from a pressure wave generator, is used to generate refrigeration for cooling liquid coolant or purging fluid, which is employed within hollow structures bordering an enclosed space of a storage unit or within the storage space of a storage unit and is subsequently cleaned of contaminants purged from the storage space.

10 Claims, 2 Drawing Sheets

BIOLOGICAL REFRIGERATION SYSTEM

TECHNICAL FIELD

This invention relates generally to refrigeration and is particularly suitable for the refrigeration of biological material.

BACKGROUND ART

Cryogenic preservation of biological material is very important in many medical and pharmaceutical fields. There are two aspects to cryogenic preservation of biological samples. The first is the preparation of the fresh sample for freezing and the controlled rate freezing of the sample. The second aspect is the long-term storage of the samples in a cryogenic state. Some cryogenic sample storage systems use an expendable cryogen such as liquid nitrogen to keep the samples cool and to absorb heat leak. The problem is that extensive infrastructure (vacuum piping etc.) and maintenance (monitoring and delivery of liquid nitrogen etc.) are required to keep these systems operating. Mechanical refrigeration systems are available for the low temperature (non-cryogenic) storage of samples. These commercial units do not attain temperatures as low as the liquid nitrogen storage systems (−140° C. for mechanical and −196° C. for liquid nitrogen). These units do not require any expendable cryogen to maintain their refrigeration. Current mechanical refrigerators are very large and inefficient due to significant heat leak through their foam insulated walls. Improved insulation and decreased heat leak into these mechanical refrigeration systems could reduce the required refrigeration capacity by an order of magnitude. Cryogenic sample storage systems are becoming increasingly popular due to increased sample viability and life span at the lower storage temperatures. These systems are more costly to operate and are less convenient due to the required regular supply and handling of liquid nitrogen. Sizes of standard cryogenic storage refrigerators are limited by safety concerns and the necessity of conserving liquid nitrogen by minimizing heat leak. Access is through the top. Units must be thawed periodically to clean-up infiltrated atmospheric contamination. Thawing is labor intensive, incurs the risk of thawing the samples and is hazardous. Size limitations may require the use of many individual units sacrificing any economies of scale.

Accordingly, it is an object of this invention to provide an improved refrigeration system which may be used to refrigerate biological material.

SUMMARY OF THE INVENTION

The above and other objects, which will become apparent to those skilled in the art upon a reading of this disclosure, are attained by the present invention, one aspect of which is:

A refrigeration system comprising:

(A) a storage unit comprising at least one hollow structure bordering an enclosed space, said hollow structure containing liquid coolant;

(B) a cryocooler having a cold head comprising a cold heat exchanger, an aftercooler and a regenerator; and (C) means for passing refrigeration from the cold head to the liquid coolant.

Another aspect of the invention is:

A refrigeration system comprising:

(A) a storage unit having a storage space;

(B) a purge gas generator, a cryocooler having a cold head, means for passing gas from the purge gas generator to the cold head of the cryocooler, and means for passing fluid from the cold head of the cryocooler into the storage space; and (C) a gas contaminant cleaning system, and means for passing gas from within the storage space to the gas contaminant cleaning system.

As used herein the term "pressure wave" means energy which causes a mass of gas to go through sequentially high and low pressure levels in a cyclic manner.

As used herein the term "cold head" means the portion of a cryocooler containing the cold heat exchanger, the aftercooler and the regenerator.

As used herein the term "membrane nitrogen generator" means a device that uses a permeable membrane to selectively separate nitrogen from other components of a compressed air stream.

As used herein the term "ejector" means a device that uses a first high energy fluid stream to entrain or move a second lower energy fluid stream. An ejector contains no moving parts. The first and second fluids are mixed during the process.

As used herein the term "cryocooler" means a refrigerator which can produce refrigeration below 200K and employs compression power of less than 50 kilowatts.

DETAILED DESCRIPTION

Figure 1:
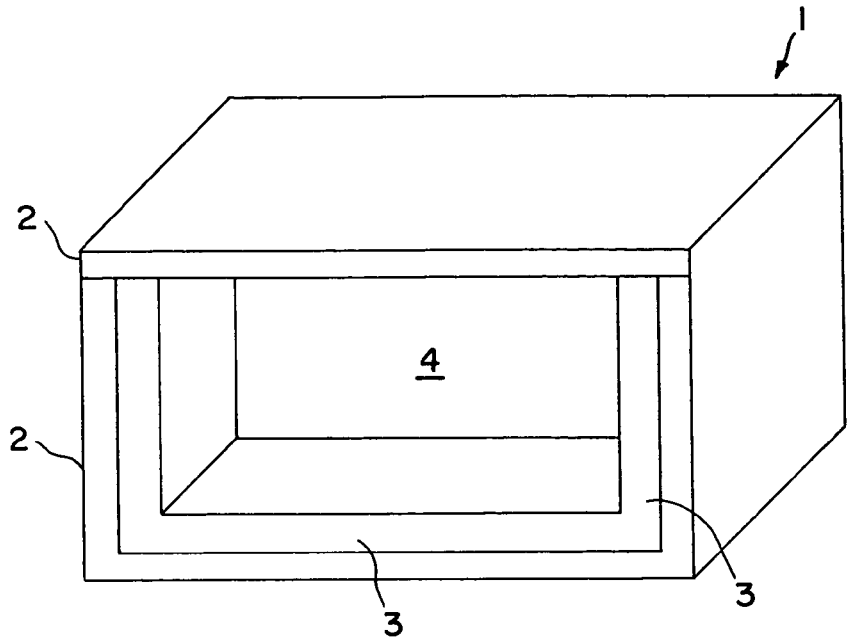
FIG. 1 is a representative illustration of a storage unit which may be used in the practice of this invention.
Figure 2:
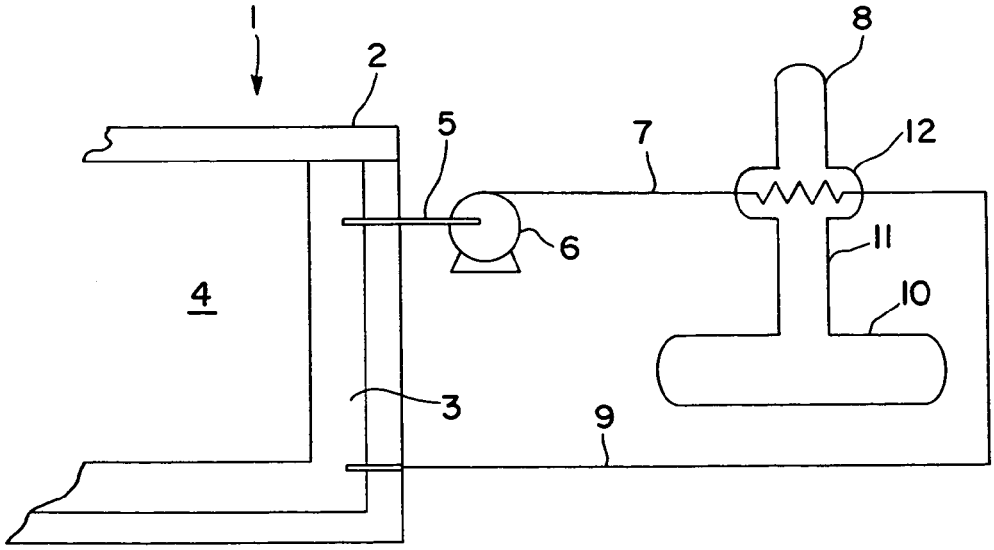
FIG. 2 is a simplified representation of one preferred embodiment of the refrigeration system of this invention.

The invention will be discussed in detail with reference to the Drawings. Referring now to FIGS. 1 and 2, storage unit 1 comprises insulated walls 2 which utilize cryogenic insulation technology such as vacuum insulation, superinsulation and getters. The storage unit illustrated in FIGS. 1 and 2 has a square or rectangular cross section wherein the walls are square or rectangular in shape. However, the storage unit may be of any other suitable shape such as a cylindrical storage unit. Conforming to the walls 2 of storage unit 1, and positioned adjacent the inside surfaces of walls 2, are one or more hollow structures 3. In the embodiment of the invention illustrated in FIGS. 1 and 2, the hollow structures 3 are in the form of hollow panels. The hollow structures serve to define enclosed space or volume 4 wherein the biological materials are stored.

The hollow structure or structures 3 contain liquid coolant. In addition to heat rejection, the coolant provides thermal ballast to maintain storage space 4 at low temperature when the unit is opened for access to the material being stored. This thermal ballast also keeps the samples cold in the event of a power outage. Non-flammable, non-hazardous, no-ozone depleting fluids or mixtures of fluids are preferred for use with this invention. For example, perfluoropropoxy-methane (HFE-347), heptafluoropropane (HFC-227ea), pentafluoropropane (HFC-245fa) and perfluoropropane (C5F12) may be used individually or in mixtures as the liquid coolant. Mixtures of HFE-347 with HFC-227ea and HFE-347 with C5F12 provide for operation down to 140 K (about −135 C). These fluids have low vapor pressure at ambient temperature. The preferred refrigerant as the liquid coolant for the current invention is tetrafluoro-methane (R14). R14 allows working temperatures down to 120 K (about −150 C). The preferred operating temperature range for the invention is between 140 K and 70 K.

The liquid coolant is maintained at the requisite cold temperature by refrigeration generated by a cryocooler such as a Stirling cryocooler, a Gifford McMahon cryocooler or a pulse tube refrigerator. In one embodiment of the invention, the refrigeration is provided to the liquid coolant by inserting the cold head or cold finger of the cryocooler into the hollow structure. In another embodiment of the invention, which is illustrated in FIG. 2, liquid coolant is withdrawn from hollow structure or panel 3 in conduit 5 and pumped by means of liquid pump 6 in line or conduit 7 to the cryocooler, which in the embodiment illustrated in FIG. 2 is a pulse tube refrigerator 8, wherein it is cooled by the refrigeration generated by the pulse tube refrigerator. The resulting cooled liquid coolant is then passed from pulse tube refrigerator 8 back to the hollow structures or panels 3 of storage unit 1 in line 9.

Pulse tube refrigerator 8 is a closed refrigeration system that oscillates a working gas in a closed cycle and in so doing transfers a heat load from a cold section to a hot section. The frequency and phasing of the oscillations is determined by the configuration of the system. Driver or pressure wave generator 10 may be a piston or some other mechanical compression device, or an acoustic or thermoacoustic wave generation device, or any other suitable device for providing a pulse or compression wave to a working gas. That is, the pressure wave generator delivers energy to the working gas within pulse tube 11 causing pressure and velocity oscillations. Helium is the preferred working gas; however any effective working gas may be used in the pulse tube refrigerator and among such one can name nitrogen, oxygen, argon and neon or mixtures containing one or more thereof such as air.

The oscillating working gas is preferably cooled in an aftercooler and then in a regenerator as it moves toward the cold heat exchanger, also known as the cold head or cold finger. The geometry and pulsing configuration of the pulse tube refrigeration system is such that the oscillating working gas in the cold head 12 expands for some fraction of the pulsing cycle and heat is absorbed by the working gas by indirect heat exchange which provides refrigeration to the liquid coolant. Refrigeration from the working gas is passed by indirect heat exchange to the liquid coolant. Some energy is dissipated in an orifice and the resulting heat is removed from the warm end typically by use of a warm heat exchanger by indirect heat exchange with cooling medium, such as water. Preferably the pulse tube refrigeration system employs an inertance tube and reservoir to maintain the gas displacement and pressure pulses in appropriate phases. The size of the reservoir is sufficiently large so that essentially very little pressure oscillation occurs in it during the oscillating flowing the pulse tube.

In another preferred embodiment of the invention, cooled fluid is passed directly into the storage space of the storage unit to cool the biological material, and then withdrawn from the storage space thus serving to purge the storage space of contaminants such as carbon dioxide and oxygen. In this embodiment the cooling and purging fluid is generally air from a compressor or nitrogen from a membrane nitrogen generator. The gas is then cooled, and may be totally or partially liquefied, by refrigeration provided from the cold head of a cryocooler, and then passed into the storage space of the storage unit. The resulting warmed and possibly vaporized fluid is withdrawn from the storage space containing contaminants which were present in the storage space, and is passed to a gas contaminant cleaning system. One embodiment of the purging and cooling aspect of the invention is illustrated in FIG. 3.

Figure 3:
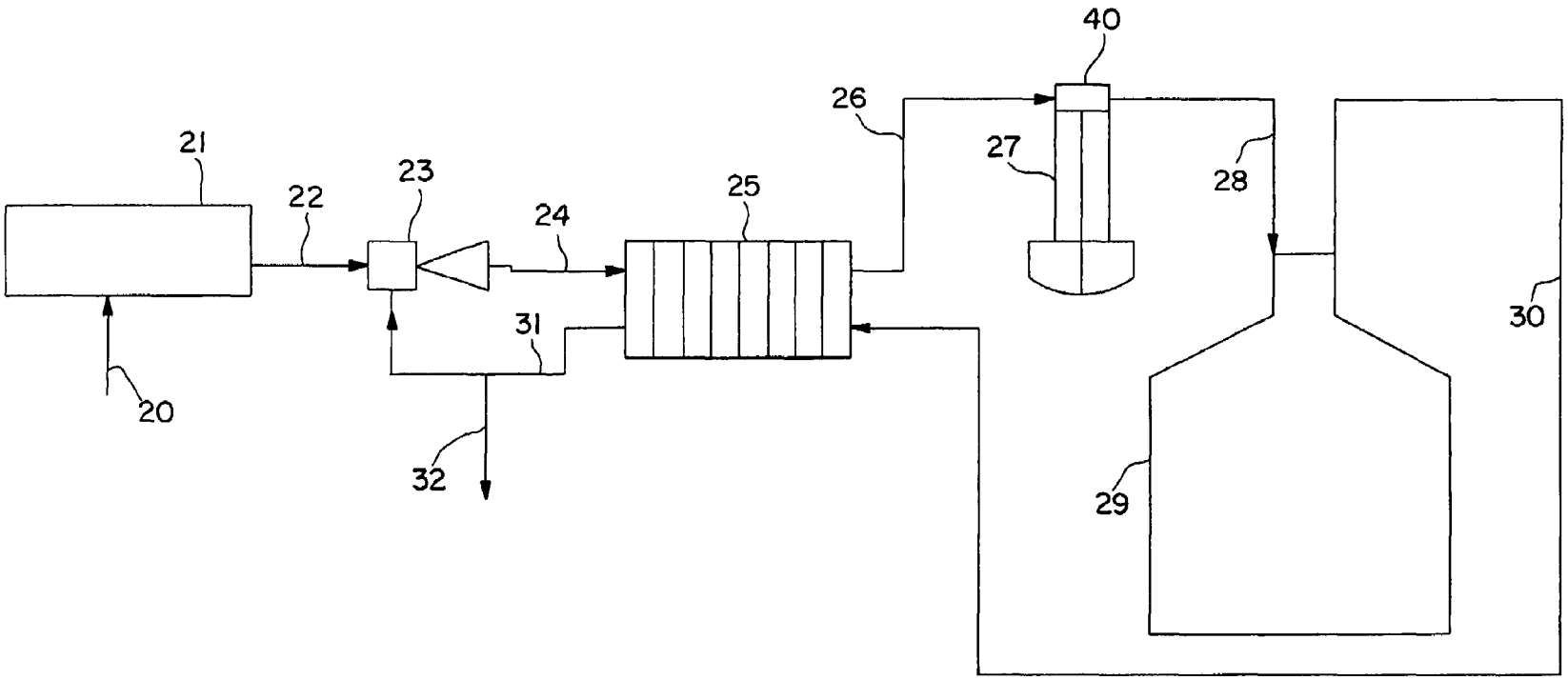
FIG. 3 is a simplified representation of another preferred embodiment of this invention.

Referring now to FIG. 3, air in stream 20 is passed to a purge gas generator 21 which may be an air compressor and air cleaning system or may be a membrane nitrogen generator. When purge gas generator 21 is a membrane nitrogen generator, there is generated nitrogen gas having a nitrogen concentration within the range of from 90 to 99 mole percent. In the embodiment illustrated in FIG. 3, nitrogen gas is withdrawn from membrane nitrogen generator 21 in stream 22 and passed to a gas contaminant cleaning system which, in the embodiment illustrated in FIG. 3 is ejector 23.

An ejector is a device that uses a high energy fluid stream to entrain or move a second lower energy fluid stream. The ejector produces a mixed stream with an energy level in between that of the first and second fluid (such that energy is conserved) and with a mass flow rate of the first and second fluids combined. The first high energy fluid stream enters the ejector converging nozzle. This causes the velocity of that first stream to increase at the expense of pressure. The stream then enters the mixing chamber where a low pressure region is created due to the momentum and viscous forces created by the first stream. This low pressure region is used to draw the second lower energy stream into the mixing chamber. The two fluids are mixed in the process. The mixed fluid then exits the mixing chamber and enter a diffuser where fluid pressure is recovered at the expense of velocity.

Nitrogen gas from ejector 23 is passed in line 24 to heat exchanger 25 wherein it is cooled by indirect heat exchange with returning nitrogen gas, and then passed in line 26 to the cryocooler, which in the embodiment illustrated in FIG. 3 is pulse tube refrigerator 27 for receiving refrigeration from cold head 40. Pulse tube refrigerator 27 operates in a similar manner as does pulse tube refrigerator 8 discussed in conjunction with FIG. 2. Cooled nitrogen fluid, which may be in gaseous, liquid or mixed phase form, is passed in line 28 from pulse tube refrigerator 27 to storage unit 29.

Storage unit 29 comprises insulated walls which define a storage space or storage volume which may be sealed or open to the atmosphere and which contains biological material which is to be cooled, frozen and/or maintained in a cooled or frozen state by the refrigeration brought into the storage space by the fluid from cold head 40. Thereafter, the resulting fluid, which is generally entirely in gaseous form and which contains contaminants from the storage space which come from the ambient atmosphere and/or the biological material, is withdrawn from the storage space and passed from storage unit 29 in line 30 to heat exchanger 29 wherein it is warmed as was previously described. The nitrogen gas is then passed in line 31 from heat exchanger 25 to ejector 23. A portion 32 of stream 31 is vented to the atmosphere.

Although the invention has been described in detail with reference to certain preferred embodiments, those skilled in the art will recognize that there are other embodiments of the invention within the spirit and the scope of the claims.

The invention claimed is:

1. A refrigeration system comprising:

(A) a storage unit having a storage space which contains biological material;

(B) a purge gas generator, a gas contaminant cleaning system, a heat exchanger, a cryocooler having a cold head, means for passing gas from the purge gas generator to the gas contaminant cleaning system, means for passing gas from the gas contaminant cleaning system to the heat exchanger and then from the heat exchanger to the cold head of the cryocooler, and means for passing fluid from the cold head of the cryocooler into the storage space; and (C) means for passing gas from within the storage space to the heat exchanger and then from the heat exchanger to the gas contaminant cleaning system.

2. The refrigeration system of claim 1 wherein the gas contaminant cleaning system comprises an ejector.

3. The refrigeration system of claim 1 wherein the purge gas generator comprises an air compressor and an air cleaning system.

4. The refrigeration system of claim 1 wherein the cryocooler is a pulse tube refrigerator comprising a pressure wave generator, and a pulse tube containing working gas for receiving a pressure wave from the pressure wave generator.

5. The refrigeration system of claim 1 wherein the means for passing gas from the heat exchanger to the gas contaminant cleaning system communicates with means for venting gas to the atmosphere.

6. A refrigeration system comprising:

(A) a storage unit having a storage space;

(B) a purge gas generator which comprises a membrane nitrogen generator, a gas contaminant cleaning system, a heat exchanger, a cryocooler having a cold head, means for passing gas from the purge gas generator to the gas contaminant cleaning system, means for passing gas from the gas contaminant cleaning system to the heat exchanger and then from the heat exchanger to the cold head of the cryocooler, and means for passing fluid from the cold head of the cryocooler into the storage space; and (C) means for passing gas from within the storage space to the heat exchanger and then from the heat exchanger to the gas contaminant cleaning system.

7. The refrigeration system of claim 6 wherein the storage space contains biological material.

8. The refrigeration system of claim 6 wherein the gas contaminant cleaning system comprises an ejector.

9. The refrigeration system of claim 6 wherein the cryocooler is a pulse tube refrigerator comprising a pressure wave generator, and a pulse tube containing working gas for receiving a pressure wave from the pressure wave generator.

10. The refrigeration system of claim 6 wherein the means for passing gas from the heat exchanger to the gas contaminant cleaning system communicates with means for venting gas to the atmosphere.

* * * * *